United States Patent [19]

De'Longhi

[11] Patent Number: 4,870,253

[45] Date of Patent: Sep. 26, 1989

[54] MOBILE APPARATUS FOR HEATING ROOMS

[75] Inventor: Giuseppe De'Longhi, Treviso, Italy

[73] Assignee: De'Longhi S.P.A., Treviso, Italy

[21] Appl. No.: 172,018

[22] Filed: Mar. 23, 1988

[30] Foreign Application Priority Data

Apr. 16, 1987 [IT] Italy ..... 82535 A/87

[51] Int. Cl.[4] ..... F24H 3/04

[52] U.S. Cl. ..... 219/369; 219/377; 219/346; 237/16

[58] Field of Search ..... 237/16, 8 R, 19, 7; 219/377, 341, 342, 346, 370, 371, 378, 369, 373

[56] References Cited

U.S. PATENT DOCUMENTS 3,941,311 3/1976 McNeely ..... 237/16

4,567,351 1/1986 Kitagawa et al. ..... 237/16

*Primary Examiner*—Henry A. Bennet

*Attorney, Agent, or Firm*—Abelman Frayne Rezac & Schwab

[57] ABSTRACT

The mobile apparatus for heating rooms has a radiator comprising a set of radiating elements inside which there flows a superior diathermal fluid, rigidly associated with a supporting body having at least one thermoventilation unit for the delivery of warm air from said body in a direction substantially orthogonal to the radiator.

2 Claims, 2 Drawing Sheets

MOBILE APPARATUS FOR HEATING ROOMS

DESCRIPTION

The present invention relates to a mobile apparatus for heating rooms.

As is known, several easily transportable apparata are currently available on the market, suitable for heating domestic rooms when the main heating thereof is insufficient or even absent.

These known apparata generally operate electrically and either employ, to produce heat, a set of radiating elements, inside which there flows a superior diathermal fluid, or are provided with incandescent resistors or again with incandescent resistors associated with a fan which allows the delivery of a flow of air, heated by said resistors, within the room.

The disadvantages of each of the known mobile heating apparata are essentially, for radiators operating with a superior diathermal fluid, considerably long times to reach the operating temperature suitable to heat the room in which heat transfer occurs only by natural convection and therefore with low yields of the apparatus; while thermoventilators have a considerable consumption of electric power with respect to the yield which they provide, though the time required to reach operating conditions is practically immediate. They are furthermore usually noisy and not free from vibrations.

The aim proposed by the present invention is to eliminate the above described disadvantages of known devices by providing a mobile apparatus for heating rooms which has a high yield together with the fact that it can supply heat to said room immediately after its activation.

Within this aim, an important object of the invention is to provide a mobile apparatus for heating rooms which has an extremely limited electric power consumption with respect to the fact of having a yield approximately 30% higher than a normal radiator.

Not least object of the present invention is to provide a mobile apparatus for heating rooms which allows to produce in the room in which it is placed a uniform air circulation so as to eliminate the difference in temperature between the lower region proximate to the floor of the room and the region proximate to the ceiling thereof using air heated even only by a superior diathermal fluid.

This aim, as well as this and other objects, are achieved by a mobile apparatus for heating rooms, characterized in that it comprises a radiator comprising a set of radiating elements, internally whereto there flows a superior diathermal fluid, rigidly associated with a supporting body having at least one thermoventilation unit for the delivery of warm air from said body in a direction substantially orthogonal to said radiator.

Figure 1:
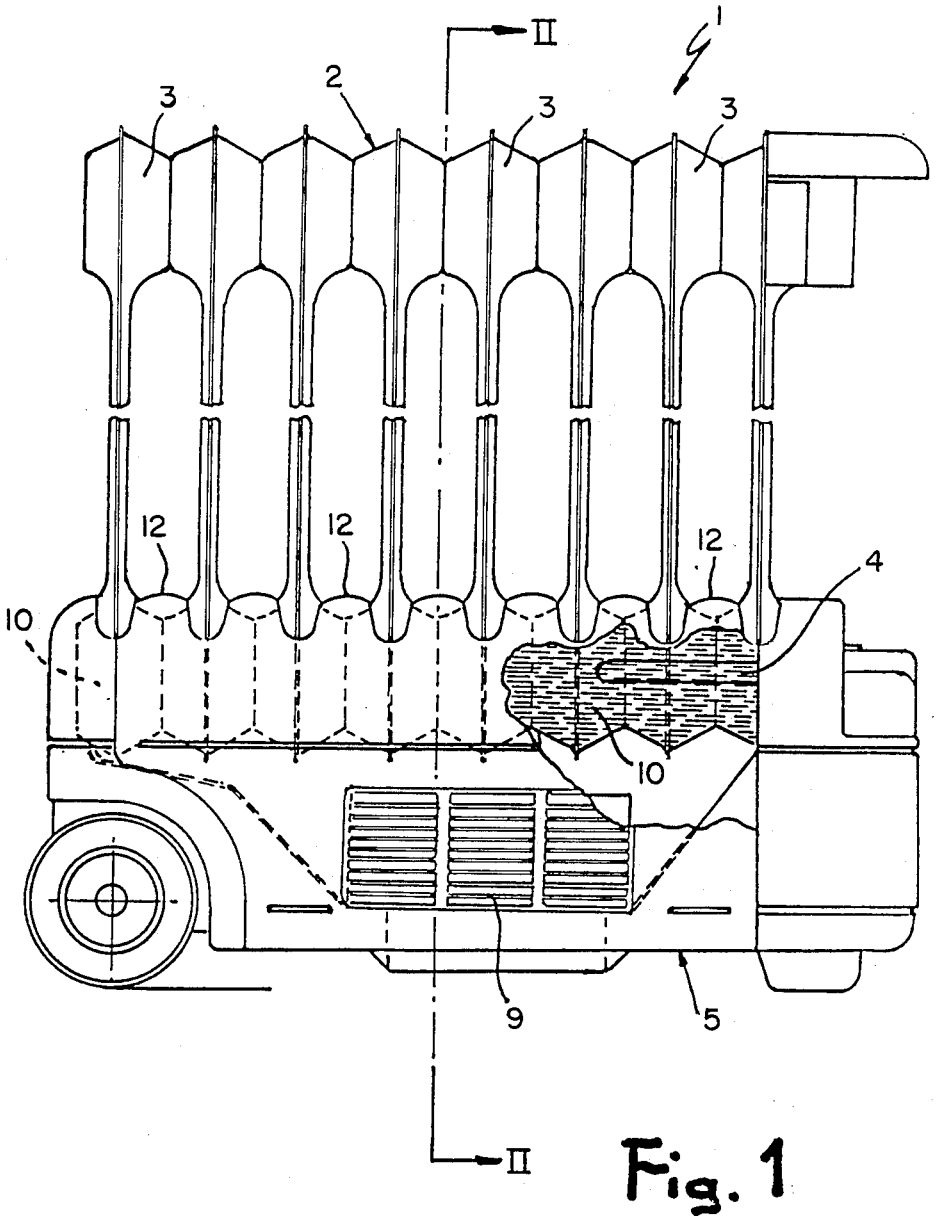
Figure 2:
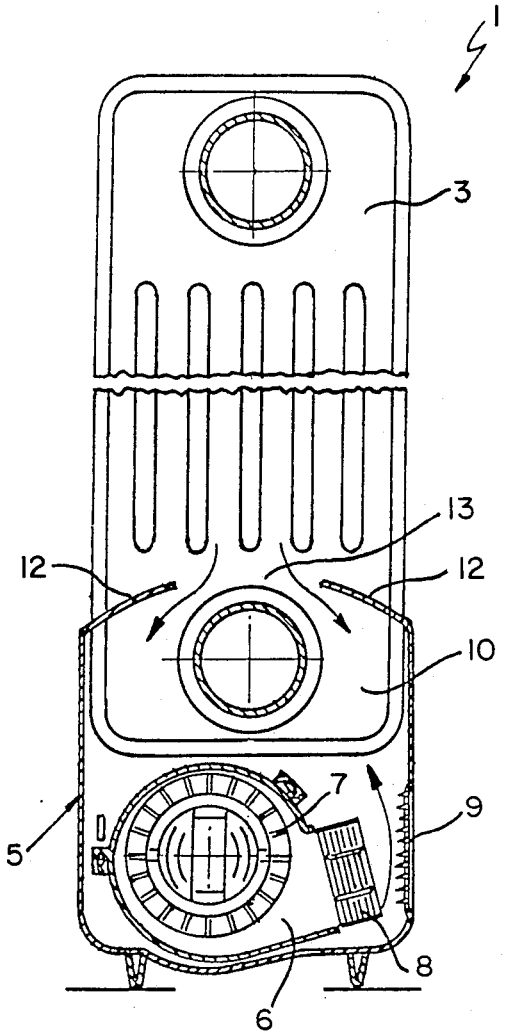

Further characteristics and advantages of the invention will become apparent from the description of a preferred but not exclusive embodiment of the mobile apparatus for heating rooms according to the invention, illustrated only by way of non-limitative example in the accompanying drawings, wherein:

FIG. 1 is a lateral elevation view, in partial cross section, illustrating the association of the radiator with the supporting body according to the invention; and FIG. 2 is a view taken along the sectional line II—II of FIG. 1 illustrating the accommodation of the thermoventilation unit inside the radiator's supporting body.

With particular reference to the above described figures, the mobile apparatus for heating rooms according to the invention, generally indicated by the reference numeral 1, comprises a radiator, generally indicated at 2, defined by a set of radiating elements, each indicated at 3, inside which there flows a superior diathermal fluid which is heated for example by means of an electric resistor 4.

The radiator 2 is rigidly supported by a supporting body, generally indicated at 5, which has in its interior, as is visible in FIG. 2, a thermoventilation unit having a fan 7 and a set of resistors 8 so as to be able to deliver warm air, through one or more flow grids 9, present on the supporting body 5, in a direction substantially orthogonal to the radiator 2.

Advantageously the radiating elements 3 extend with one of their portions, indicated at 10, inside the supporting body 5 so as to be proximate to the thermoventilation unit 6.

Conveniently, the supporting body 5 has a plurality of fingers, each indicated at 12, which extend inside the radiating elements 3, on both sides of the supporting body 5, and so as to determine an opening 13 between two counterposed fingers 12 so as to defined a plurality of preferential channels for the flow of air which is aspirated by the thermoventilation unit 6.

In this manner, when the radiator has reached its optimum operating temperature, the thermoventilation unit 6 aspirates preheated air arriving from the set of radiating elements 3 which, if required, is also made to flow through the resistors 8 so as to increase its temperature.

Taking into account that in a room the temperature variation between the floor and the ceiling is approximately 4 degrees, by providing a uniform air circulation it is possible to obtain with the mobile apparatus according to the invention a yield approximately 30% higher than the yield of a normal radiator since the decrease of natural convection and the increase of forced convection are determined.

The thermoventilation unit 6 can furthermore perform a partial rotation about its own axis of pivoting to the supporting body so as to direct the resistors 8 either proximate tko the grid 9 or partially against the portion 10 of the radiating elements cooperating to heat the diathermal oil contained therein so as to accelerate the attainment of the optimum operating temperature of the heater for the heating of the room.

The operation of the mobile apparatus for heating rooms according to the invention is evident from what has been described and illustrated.

In particular, since as is known a radiator operating with diathermal oil requires a rather long time to reach operating conditions from when the resistor 4 is activated to when it starts emitting heat by natural convection, it is possible to activate, simultaneously with the radiator, also the thermoventilation unit which will instead superheat the air to be introduced in the room to be heated practically immediately.

In this manner it is possible to obtain the advantage of instantly having an initial heating of the room without waiting for the diathermal-fluid radiator to reach operating temperature.

Then, when the radiator has reached its normal operating conditions, it is possible, by means of activation means such as known switches, to bypass the thermoventilation unit or to leave it operating with or without the resistors 8 activated.

If the resistors 8 are deactivated, the thermoventilation unit aspirates from the preferential channels, defined by the openings 13 comprised between the fingers 12 of the supporting body, an amount of heated air which is circulated in the room, decreasing natural convection and increasing forced convection obtaining, due to what has already been mentioned, a yield higher by 30% with respect to a normal radiator.

If the room is particularly cold, it is furthermore possible to keep the resistors 8 activated so as to considerably increase the temperature of the preheated air arriving from the radiator to introduce it, through the grid 9, in the room to be heated. Evidently, when the radiator and the thermoventilation unit simultaneously heat the air the heating times of the room are considerably lower.

In practice it has been observed that the mobile apparatus for heating rooms according to the invention is particularly advantageous in that it has enormous flexibility in use and furthermore in that it allows the elimination of the disadvantages deriving from radiators operating with diathermal fluid, that is to say long times required to reach operating temperature, and the disadvantages deriving from the use of thermoventilators, that is to say the fact of having, due to the presence of a plurality of incandescence resistors, an excessive consumption of electric power.

The invention thus conceived is susceptible to numerous modifications and variations, all of which are within the scope of the inventive concept; furthermore, all the details may be replaced with other technically equivalent elements.

In practice, the materials employed, as well as the dimensions, may be any according to the requirements and to the state of the art.

I claim:

1. In combination:

an electrically powered radiator having an upper header, a lower header, and heat radiating tubes interconnecting said upper and lower headers, said radiator containing a diathermal fluid in which an electrical heating element is submerged;

A hollow casing positioned beneath said radiator and providing a support for said radiator, said casing having a rear wall, bottom wall and end walls defining a substantially imperforate enclosure for said lower header, said casing also having a front wall having a grid for the passage of air, and also having portions comprising a top wall of said casing, said portions extending between said heat radiating tubes and defining a constricted opening into the interior of said casing at a position located above said lower header;

a centrifugal fan mounted within said hollow casing, centrifugal fan having an impeller and a torroidal housing for said impeller, said housing having a tangential outlet for air impelled by said fan; and, means mounting said fan housing for angular adjustment between a first position in which said outlet is positioned proximate said casing grid, and a second position in which said outlet is positioned beneath said lower header and directed upwardly against an underside of said lower header.

2. The combination of claim 1, further including a resistive electrical heating element mounted in said outlet of said fan housing, and which is movable in unison with said fan housing between said first and second positions.

* * * * *